US010632513B2

(12) United States Patent
Tsay

(10) Patent No.: US 10,632,513 B2
(45) Date of Patent: Apr. 28, 2020

(54) ROTATIONAL EXTRUSION MOLDING DIE AND SLENDER METAL WORKPIECE MADE WITH SAME

(71) Applicant: NATIONAL CHUNG SHAN INSTITUTE OF SCIENCE AND TECHNOLOGY, Taoyuan (TW)

(72) Inventor: Gow-Dong Tsay, Taoyuan (TW)

(73) Assignee: NATIONAL CHUNG SHAN INSTITUTE OF SCIENCE AND TECHNOLOGY (TW)

( * ) Notice: Subject to any disclaimer, the term of this patent is extended or adjusted under 35 U.S.C. 154(b) by 706 days.

(21) Appl. No.: 15/346,910

(22) Filed: Nov. 9, 2016

(65) Prior Publication Data

US 2017/0128995 A1 May 11, 2017

(30) Foreign Application Priority Data

Nov. 11, 2015 (TW) ..... 104137103 A

(51) Int. Cl.
*B21C 23/21* (2006.01)
*B21C 25/02* (2006.01)

(52) U.S. Cl.
CPC ..... *B21C 23/21* (2013.01); *B21C 23/211* (2013.01); *B21C 25/02* (2013.01)

(58) Field of Classification Search
CPC ..... B21C 23/001; B21C 23/02; B21C 23/04; B21C 23/08; B21C 23/21; B21C 23/211; B21C 23/212; B21C 23/214; B21C 23/215; B21C 25/02; B21C 23/085; B21C 23/217
See application file for complete search history.

(56) References Cited

U.S. PATENT DOCUMENTS 3,147,863 A * 9/1964 Rosenthal ..... B21C 23/212 72/255
3,158,258 A * 11/1964 Kelday ..... B21C 3/04 72/64
3,345,854 A * 10/1967 Gross ..... B21C 23/214 72/263
3,728,884 A * 4/1973 Santoli ..... B21C 23/212 72/273

(Continued)

*Primary Examiner* — Edward T Tolan
(74) *Attorney, Agent, or Firm* — Schmeiser, Olsen & Watts, LLP

(57) ABSTRACT

A rotational extrusion molding die and a slender metal workpiece made with same are introduced. The rotational extrusion molding die includes a female mold device, a male mold device, and a rotation driving device. The female mold device is symmetric about an axis to define a cavity corresponding in shape to the slender metal workpiece. The male mold device is movable controllably along the axis relative to the female mold device, allowing the metal blank to pass through the cavity and thereby turn into the slender metal workpiece. The rotation driving device drives the female mold device to rotate about the axis relative to the male mold device. The slender metal workpiece thus manufactured has continuous metal flow lines which extend continually along the axis and along an arc defined by the axis, thereby improving the slender metal workpiece in mechanical properties, mechanical strength, and damping capacity.

4 Claims, 5 Drawing Sheets

(56) References Cited

U.S. PATENT DOCUMENTS

| | | | | | |
|---|---|---|---|---|---|
| 4,300,378 | A * | 11/1981 | Thiruvarudchelvan | B21C 3/12 | 72/253.1 |
| 5,737,959 | A * | 4/1998 | Korbel | B21B 1/166 | 72/256 |
| 2014/0102159 | A1* | 4/2014 | Denison | B21C 23/005 | 72/253.1 |
| 2014/0283574 | A1* | 9/2014 | Lavender | B21C 23/002 | 72/262 |
| 2015/0075242 | A1* | 3/2015 | Eller | B21C 37/20 | 72/68 |

* cited by examiner

ROTATIONAL EXTRUSION MOLDING DIE AND SLENDER METAL WORKPIECE MADE WITH SAME

CROSS-REFERENCE TO RELATED APPLICATION

This non-provisional application claims priority under 35 U.S.C. § 119(a) on Patent Application No(s). 104137103 filed in Taiwan, R.O.C. on Nov. 11, 2015, the entire contents of which are hereby incorporated by reference.

FIELD OF THE INVENTION

The present invention relates to extrusion molding dies and finished products thereof and, more particularly, to a rotational extrusion molding die and a slender metal workpiece made with same.

BACKGROUND OF THE INVENTION

Referring to FIG. 1, a conventional extrusion molding die 1 comprises a female mold 11 which a hole 111 is formed therein and a post 12 insertedly disposed in the female mold 11. The post 12 presses against a metal blank 100 disposed in the female mold 11 such that the metal blank 100 passes through the hole 111 of the female mold 11 to form a slender metal workpiece 101.

Referring to FIGS. 1, 2, metal flow lines 102 of the slender metal workpiece 101 manufactured with the extrusion molding die 1 are continuous. Hence, the slender metal workpiece 101 displays satisfactory mechanical properties, mechanical strength and thus is widely used in the manufacturing of mechanical parts and components which have strict safety requirements.

However, with the metal flow lines 102 being linear, the slender metal workpiece 101 has poor damping capacity. In view of this, it is important to improve the slender metal workpiece 101 in terms of mechanical properties, mechanical strength, and damping capacity.

SUMMARY OF THE INVENTION

The object of the present invention is to provide a rotational extrusion molding die capable of manufacturing a slender metal workpiece with enhanced mechanical properties, mechanical strength, and damping capacity.

To this end, the present invention provides a rotational extrusion molding die for manufacturing a slender metal workpiece from a metal blank. The rotational extrusion molding die comprises a female mold device, a male mold device corresponding in position to the female mold device, and a rotation driving device.

The female mold device is symmetric about an axis to define a cavity corresponding in shape to the slender metal workpiece. The male mold device is movable controllably along the axis relative to the female mold device, allowing the metal blank to pass through the cavity and thereby turn into the slender metal workpiece. The rotation driving device drives the female mold device to rotate about the axis relative to the male mold device.

Another objective of the present invention is to provide a slender metal workpiece which displays enhanced mechanical properties, mechanical strength, and damping capacity. The slender metal workpiece comprises metal flow lines. The metal flow lines are continuous, extend continually along an axis, and extend along an arc defined by the axis.

Yet another objective of the present invention is to provide a slender metal workpiece which displays enhanced mechanical properties, mechanical strength, and damping capacity. The slender metal workpiece comprises a central hole symmetric about an axis and metal flow lines continuous, extending continually along the axis, and extending along an arc defined by the axis.

The advantages of the present invention are as follows: a female mold device is driven by a rotation driving device to rotate about an axis relative to the male mold device, so as to manufacture a slender metal workpiece which has metal flow lines being continuous, extending continually along an axis, and extending along an arc defined by the axis, thereby improving the slender metal workpiece in terms of mechanical properties, mechanical strength, and damping capacity.

DETAILED DESCRIPTION OF THE PREFERRED EMBODIMENTS

Figure 1:
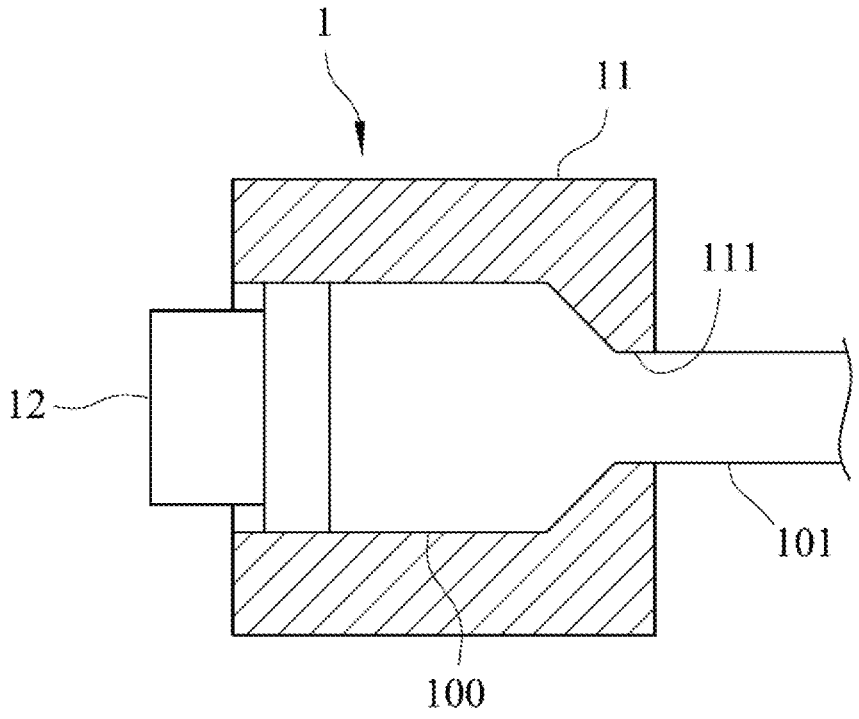
(PRIOR ART) FIG. 1
FIG. 1 (PRIOR) is a schematic view of a conventional extrusion molding die.
Figure 2:
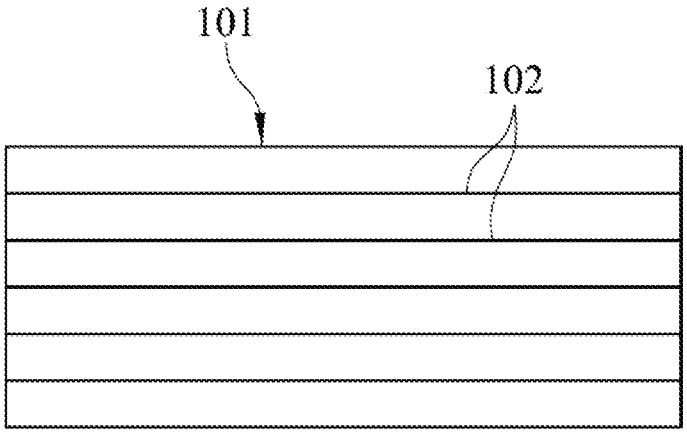
(PRIOR ART) FIG. 2
FIG. 2 (PRIOR) is a schematic view of metal flow lines of a slender metal workpiece manufactured with the conventional extrusion molding die.

Any two or more like components described hereunder are denoted with the same reference numeral.

Figure 3:
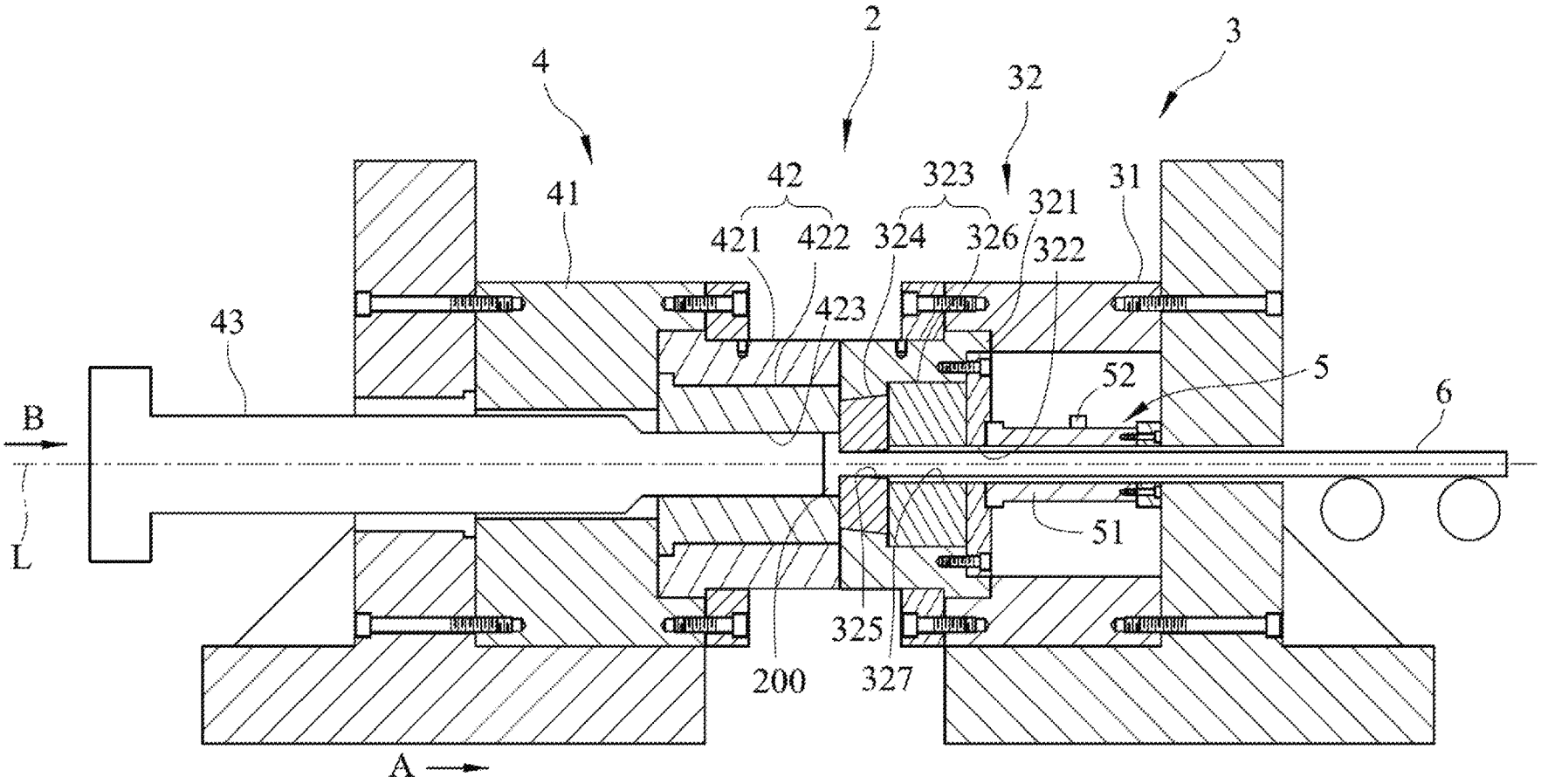
FIG. 3 is a schematic view of a rotational extrusion molding die according to the first embodiment of the present invention.

Referring to FIG. 3, in the first embodiment of the present invention, a rotational extrusion molding die 2 for manufacturing a slender metal workpiece 6 from a metal blank 200. The rotational extrusion molding die 2 comprises a female mold device 3, a male mold device 4, and a rotation driving device 5 for driving the female mold device 3.

The female mold device 3 defines a cavity 325 corresponding in shape to the slender metal workpiece 6 and symmetric about an axis L. The female mold device 3 comprises a female mold support 31 and a rotational molding unit 32 mounted on the female mold support 31 and symmetric about the axis L to define the cavity 325. The rotation driving device 5 drives the rotational molding unit 32 to rotate about the axis L relative to the female mold support 31 and the male mold device 4. The rotational molding unit 32 comprises a base 321 symmetric about the axis L to thereby be pivotally disposed at the female mold support 31 and a female mold core 323 removably disposed at the base 321 and symmetric about the axis L to define the cavity 325. A penetrating hole 322 is disposed in the base 321 to communicate with the cavity 325 of the female mold core 323 and extends along the axis L. The female mold core 323 comprises a core 324 and a pad 326 disposed between the core 324 and the base 321. A connecting hole 327 is disposed in the pad 326 to enable communication between the cavity 325 and the penetrating hole 322.

The male mold device 4 is movable controllably along the axis L relative to the female mold device 3, allowing the metal blank 200 to pass through the cavity 325 and thereby turn into the slender metal workpiece 6. The male mold device 4 comprises a male mold support 41 disposed at the axis L and spaced apart from the female mold support 31, a male mold core 42 demountably disposed on the male mold support 41 to operate in conjunction with the rotational molding unit 32, and a post 43 for penetrating the male mold support 41 and the male mold core 42. The male mold core 42 comprises an outer sleeve 421 demountably disposed on the male mold support 41 and an inner sleeve 422 operable in conjunction with the cavity 325 and thereby replaceably disposed at the outer sleeve 421. The inner sleeve 422 has a receiving space 423 for receiving the metal blank 200. The post 43 is penetratingly disposed in the receiving space 423.

The rotation driving device 5 drives the female mold device 3 to rotate about the axis L relative to the male mold device 4. The rotation driving device 5 comprises a connection mechanism 51 connected to a base 321 of the rotational molding unit 32 and a power source 52 for actuating the connection mechanism 51 to drive the rotational molding unit 32 to rotate about the axis L. In this embodiment, the connection mechanism 51 is a connection pipe which extends along the axis L to connect with the base 321, whereas the power source 52 is a motor for driving the connection mechanism 51 to rotate about the axis L.

Figure 4:
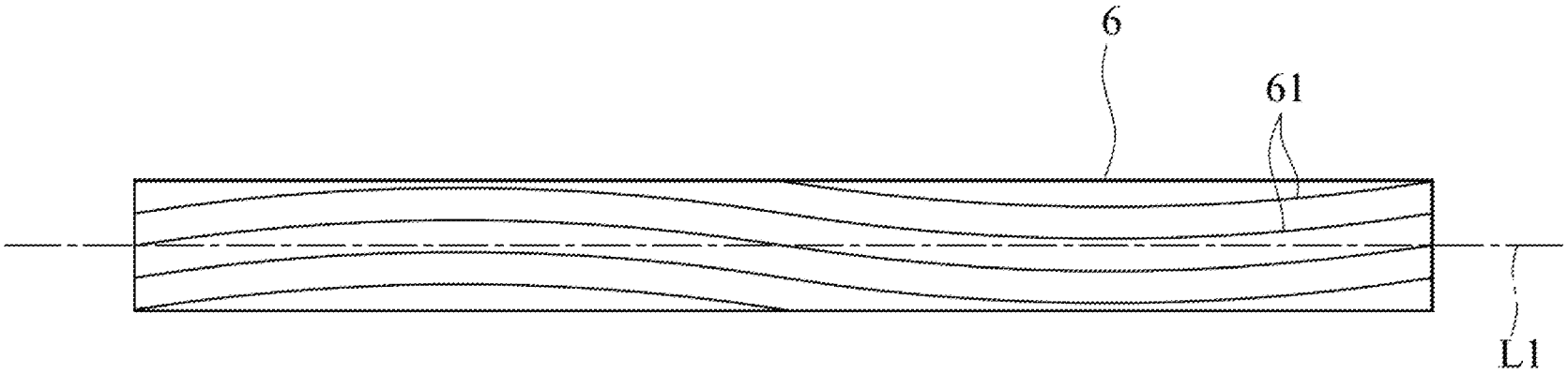
FIG. 4 is a schematic view of a slender metal workpiece manufactured according to the first embodiment of the present invention.

In practice, a worker places a metal blank 200 in a receiving space 423 of the inner sleeve 422, aligns the male mold core 42 with the female mold core 323 in the direction indicated by arrow A shown in FIG. 3, and pushes the post 43 in the direction indicated by arrow B shown in FIG. 3 to allow the metal blank 200 in the receiving space 423 to pass through the cavity 325 of the core 324, the connecting hole 327 of the pad 326, the penetrating hole 322 of the base 321, the connection mechanism 51, and the female mold support 31; meanwhile, the power source 52 actuates the connection mechanism 51 to rotate about the axis L and thereby drive the rotational molding unit 32 to rotate about the axis L relative to the female mold support 31 and the male mold device 4. Hence, the metal blank 200 is subjected to a torque while passing through the cavity 325, and in consequence the metal blank 200 turns into the slender metal workpiece 6 which extends along an axis L1 as shown in FIG. 4. The slender metal workpiece 6 has metal flow lines 61 which are continuous, extend continually along the axis L1, and extend along an arc defined by the axis L1, thereby improving the slender metal workpiece 6 in terms of mechanical properties, mechanical strength, and damping capacity.

Figure 5:
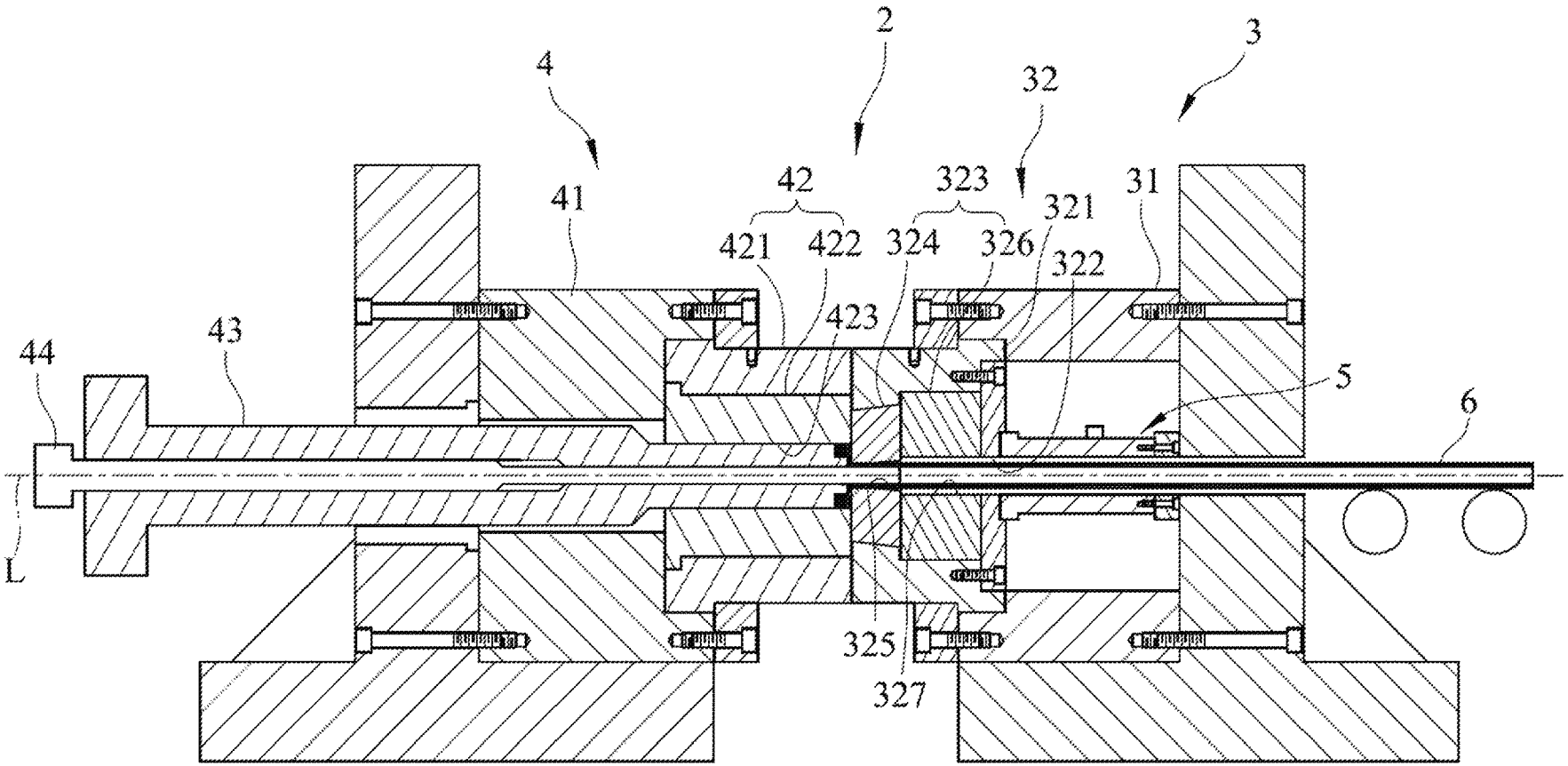
FIG. 5 is a schematic view of the rotational extrusion molding die according to the second embodiment of the present invention.

Referring to FIG. 5, regarding the rotational extrusion molding die 2 of the present invention, its second embodiment is distinguished from its first embodiment by: the male mold device 4 further comprises a spindle 44 insertedly disposed in the post 43 and protruded into the cavity 325.

Figure 6:
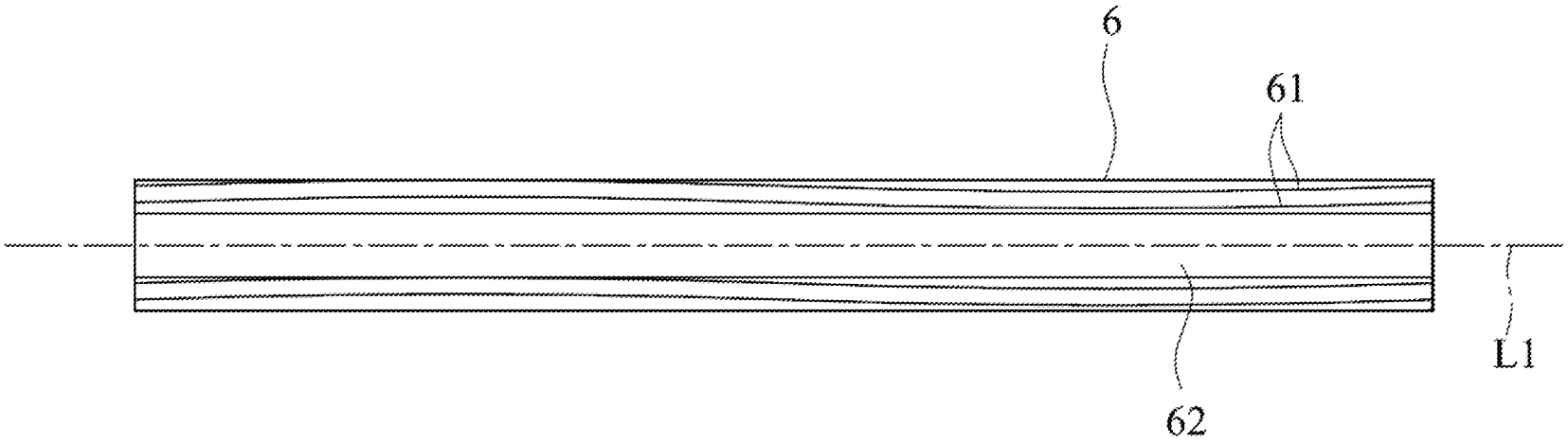
FIG. 6 is a schematic view of the slender metal workpiece manufactured according to the second embodiment of the present invention.

Hence, in addition to the advantages of the first embodiment, the second embodiment achieves an advantage, that is, using the spindle 44 to manufacture the slender metal workpiece 6 which has a central hole 62, as shown in FIG. 6.

In conclusion, according to the present invention, the rotational extrusion molding die 2 and the slender metal workpiece 6 made with the rotational extrusion molding die 2 are characterized in that: using the rotation driving device 5 to drive the female mold device 3 to rotate about the axis L relative to the male mold device 4, so as to manufacture the slender metal workpiece 6 which has the metal flow lines 61 which are continuous, extend continually along the axis L1, and extend along an arc defined by the axis L1, thereby improving the slender metal workpiece 6 in terms of mechanical properties, mechanical strength, and damping capacity.

The present invention is disclosed above by preferred embodiments. However, persons skilled in the art should understand that the preferred embodiments are illustrative of the present invention only, but should not be interpreted as restrictive of the scope of the present invention. Hence, all equivalent variations and modifications made to the aforesaid embodiments should fall within the scope of the present invention. Accordingly, the legal protection for the present invention should be defined by the appended claims.

What is claimed is:

1. A rotational extrusion molding die, for manufacturing a slender metal workpiece from a metal blank, comprising:

a female mold device symmetric about an axis to define a cavity corresponding in shape to the slender metal workpiece;

a male mold device movable controllably along the axis relative to the female mold device, allowing the metal blank to pass through the cavity and thereby turn into the slender metal workpiece; and a rotation driving device for driving the female mold device to rotate about the axis relative to the male mold device;

wherein the female mold device comprises a female mold support, and a rotational molding unit mounted on the female mold support, symmetric about the axis to define the cavity, and driven by the rotation driving device to rotate about the axis relative to the female mold support and the male mold device;

wherein the rotation driving device is disposed in the female mold support and comprises a connection mechanism connected to the rotational molding unit and a power source disposing along the axis for actuating the connection mechanism to drive the rotational molding unit to rotate about the axis;

wherein the rotational molding unit comprises a base symmetric about the axis to thereby be pivotally disposed at the female mold support and a female mold core removably disposed at the base and symmetric about the axis to define the cavity, with a penetrating hole disposed in the base to communicate with the cavity of the female mold core and extending along the axis, with the connection mechanism being a connection pipe connected to the base along the axis.

2. The rotational extrusion molding die of claim 1, wherein the male mold device comprises a male mold support disposed at the axis and spaced apart from the female mold support, a male mold core demountably disposed on the male mold support to operate in conjunction with the rotational molding unit, and a post for penetrating the male mold support and the male mold core to push and cause the metal blank to pass through the cavity.

3. The rotational extrusion molding die of claim 2, wherein the male mold device further comprises a spindle insertedly disposed in the post and protruded into the cavity.

4. The rotational extrusion molding die of claim 2, wherein the male mold core comprises an outer sleeve demountably disposed on the male mold support and an inner sleeve operable in conjunction with the cavity and thereby replaceably disposed at the outer sleeve, with the inner sleeve having a receiving space for receiving the metal blank, with the post being penetratingly disposed in the receiving space.

* * * * *